United States Patent [19]

McHenry

[11] 4,434,715

[45] Mar. 6, 1984

[54] PRINTING APPARATUS INCLUDING SERIAL PRINTING MEANS

[75] Inventor: Max D. McHenry, Fremont, Calif.

[73] Assignee: A. B. Dick Company, Chicago, Ill.

[21] Appl. No.: 331,630

[22] Filed: Dec. 17, 1981

[51] Int. Cl.[3] ..... B41L 45/00

[52] U.S. Cl. ..... 101/76; 101/72

[58] Field of Search ..... 101/57, 63, 76, 77, 101/86, 87, 93.11, 153, 216; 74/411.5, 527

[56] References Cited

U.S. PATENT DOCUMENTS

| | | | |
|---|---|---|---|
| 1,443,164 | 1/1923 | Bracken | 101/5 |
| 1,624,685 | 4/1927 | Smith | 101/57 |
| 1,655,792 | 1/1928 | Krell | 101/57 |
| 2,398,832 | 4/1946 | Jirousek | 101/77 |
| 3,039,387 | 6/1962 | Zimmer et al. | 101/216 |
| 3,611,921 | 10/1971 | Jahn | 101/77 |
| 3,728,960 | 4/1973 | Heath | 101/76 |
| 3,782,277 | 1/1974 | Neal | 101/76 |
| 3,783,782 | 1/1974 | Hardt | 101/216 |
| 3,789,757 | 2/1974 | Motter et al. | 101/153 |
| 4,044,666 | 8/1977 | Doucet | 101/77 X |
| 4,244,291 | 1/1981 | Kodaira et al. | 101/99 |

FOREIGN PATENT DOCUMENTS

| | | | |
|---|---|---|---|
| 1101446 | 3/1961 | Fed. Rep. of Germany | 101/216 |

OTHER PUBLICATIONS

American Printer and Lithographer, p. 92 (Jun. 1981).

42A. B. Dick Service Bulletin No. 0-59-1966 (May 25, 1966).

Operating Instructions for A. B. Dick Models 350/360, Offset Equipment (undated).

*Primary Examiner*—Edgar S. Burr

*Assistant Examiner*—John A. Weresh

*Attorney, Agent, or Firm*—McDougall, Hersh & Scott

[57] ABSTRACT

A printing apparatus including separate serial printing heads mounted on a rotary chase whereby the heads can be selectively positioned for printing on material as the material is transported through the apparatus. The chase is mounted on a support located in an easily accessible position in the apparatus whereby the rotation of the chase to change the head or heads to be used in a printing operation can be easily accomplished. The chase is also removably positioned on the support so that an entire chase can be readily separated from the apparatus, and a different chase with different printing heads substituted in the apparatus. The chase is equipped with guides which cooperate with guides on the apparatus frame to insure automatic alignment of the chase as it is located in operating position, and the drive shafts carrying the printing heads are at the same time automatically engaged with drive means associated with the apparatus. Locking mechanisms are provided to secure the chase in position relative to the frame and the chase is also equipped with pins engageable with the apparatus frame and having the capability of adjusting printing head pressure on the material being printed. The chase is also equipped with means for automatically shifting the heads between "On Impression" and "Off Impression" positions in the course of a printing run.

18 Claims, 18 Drawing Figures

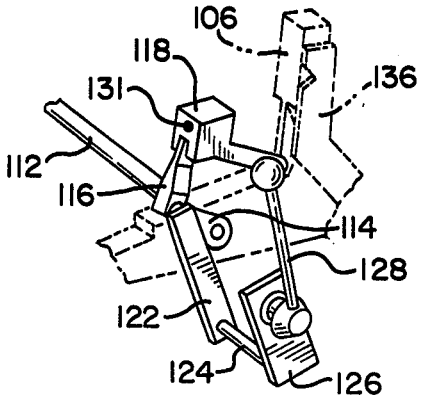
FIG. 14
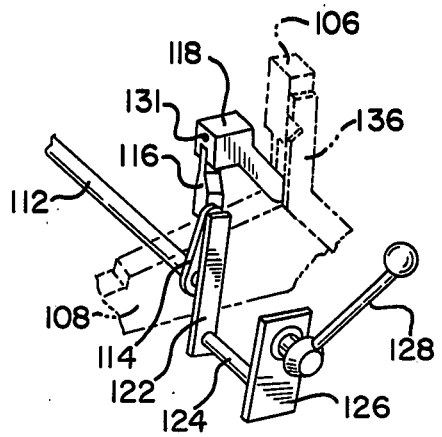
FIG. 14A
FIG. 15
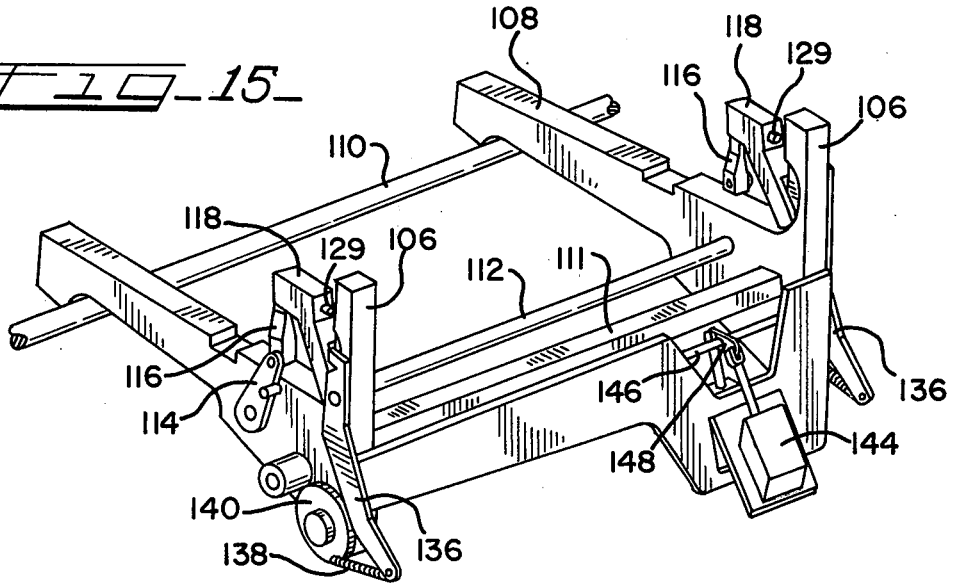

PRINTING APPARATUS INCLUDING SERIAL PRINTING MEANS

BACKGROUND OF THE INVENTION

This invention relates to a printing apparatus which utilizes means for serially printing characters on paper or the like as the paper is transported through the apparatus. The invention is particularly concerned with a serial printing means suitable for use as a component in a conventional offset printing press.

This invention will be described with reference to serial printing means comprising numbering machines which will apply numbers in series to bank checks which are at the same time being personalized by the offset printing press. When considering the following discussion, it will be appreciated that serial printing means capable of printing other characters on material of different types is contemplated by the invention.

In the printing of checks utilizing an offset printing press, blank check forms may be fed to the printing press with common printing already located thereon. This common printing may, for example, comprise the phrase "Pay to the order of" and lines for writing in the date, payee, amounts and signature. The offset printing press would then be utilized for personalizing the forms by printing information unique to a set of checks including the name of a bank and the name and address of a depositer.

As disclosed in U.S. Pat. No. 3,611,921, U.S. Pat. No. 3,782,277 and U.S. Pat. No. 3,728,960 it has previously been suggested that serial numbering machines be incorporated in offset printing presses. Such machines would then perform the serial numbering operation required in check printing, that is the application of numbers which will distinguish each check from every other check.

The aforementioned U.S. Pat. No. 3,728,960 recognizes that the numbering operation is preferably performed in tandem in the same machine before release of the paper or other stock being printed. This permits carrying out the respective printing operations in timed relationship and also insures accurate placement of numbers on the checks. The latter is highly important where the numbers are printed in magnetic ink with the checks to be read by automatic equipment.

U.S. Pat. No. 3,728,960 also disclosed a rotatable support for separate sets of numbering machines. This structure locates one set of numbering machines in printing position. Once a printing operation has been completed, the support structure can be moved to the side of the machine and rotated externally of the machine to reverse the positions of the numbering heads on the support. When the support structure is then moved laterally back into the machine, the other set of numbering heads will then be in printing position. This arrangement permits the operator to make changes on the set of numbering heads not in use during the printing operation involving the other set of numbering heads. A minimum of down time is, therefore, require between printing operations using the two sets of heads.

SUMMARY OF THE INVENTION

The general object of this invention is to provide a highly efficient means for achieving serial printing in tandem with other printing operations both from the standpoint of increasing the output of the press and from the standpoint of the quality of the work performed.

The invention particularly comprises a printing apparatus including separate serial printing heads mounted on a rotary chase whereby the heads can be selectively positioned for printing on paper stock or other material as the material is transported through the apparatus. The rotary chase is mounted on a support located in an easily accessible position in the apparatus whereby the rotation of the chase to change the head or heads to be used in a printing operation can be easily accomplished.

The rotary chase is also removably positioned on its support so that an entire chase can be readily separated from the apparatus, and a different chase with different printing heads substituted in the apparatus. The support is pivotally mounted so that the chase can be conveniently located for rotation or removed.

The chase is equipped with guides which cooperate with other guides on the apparatus frame to insure automatic alignment of the chase when its support is pivoted to operating position. Means are provided to insure that at the same time, the drive shafts carrying the printing heads are automatically engaged with drive means associated with the apparatus.

Locking mechanisms secure the chase in position relative to the frame when the support pivots to operating position, and the chase is equipped with adjustable pins engageable with the apparatus frame and having the capability of adjusting printing head pressure on the material being printed. The chase is also equipped with means for automatically shifting the heads between "On Impression" and "Off Impression" positions in the course of a printing run.

BRIEF DESCRIPTION OF THE DRAWINGS

FIG. 14 is a detailed perspective view of the locking means in the open position;

FIG. 14A is a detailed perspective view of the locking means moved to a closed position; and, FIG. 15 is a perspective view of the rotary chase viewed from the forward end.

DESCRIPTION OF THE PREFERRED EMBODIMENTS

Figure 1:
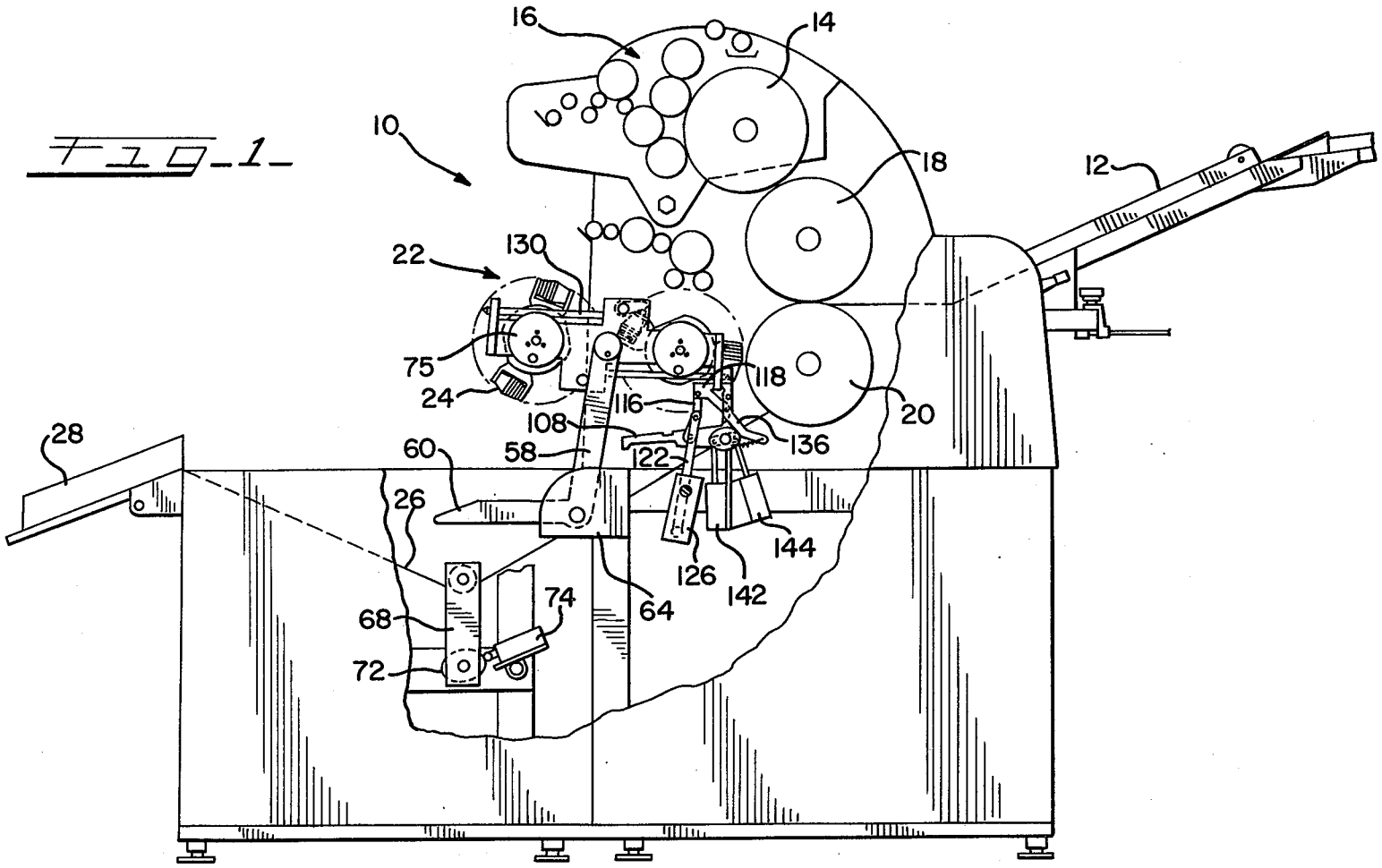
FIG. 1 is a side elevational view, partly cut away, illustrating an offset printing press characterized by the features of this invention.

FIG. 1 illustrates an offset printing press 10 having an inlet table 12 for receiving a stack of material to be printed. This is a table of the type shown in U.S. Pat. No. 3,512,479, but it will be appreciated that tables of other types are usable when practicing the invention. The apparatus also includes the conventional plate cylinder 14 having an associated inking mechanism shown generally at 16. A blanket cylinder 18 cooperates with adjacent impression cylinder 20 to achieve printing of sheets fed from the table 12.

A rotary chase 22 is positioned for supporting serial numbering heads such as shown at 24 whereby the heads will print numbers on each sheet exiting from between the blanket cylinder and impression cylinder. The sheets are then transferred onto belt conveyor means 26 for ultimate discharge onto receiving table 28.

Figure 2A:
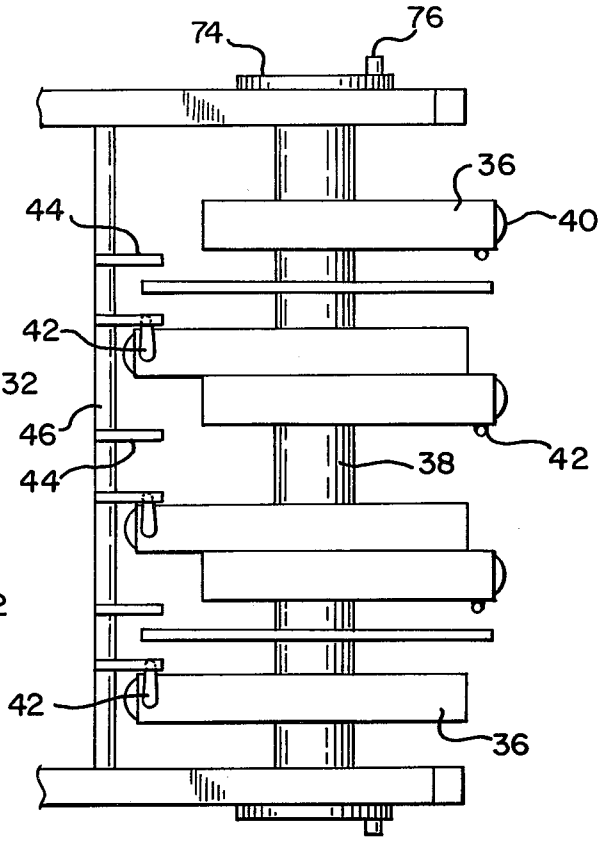
FIG. 2A is a fragmentary schematic illustration of serial numbering machines on a supporting shaft which are adapted to serially print numbers on the check blanks.
Figure 2:
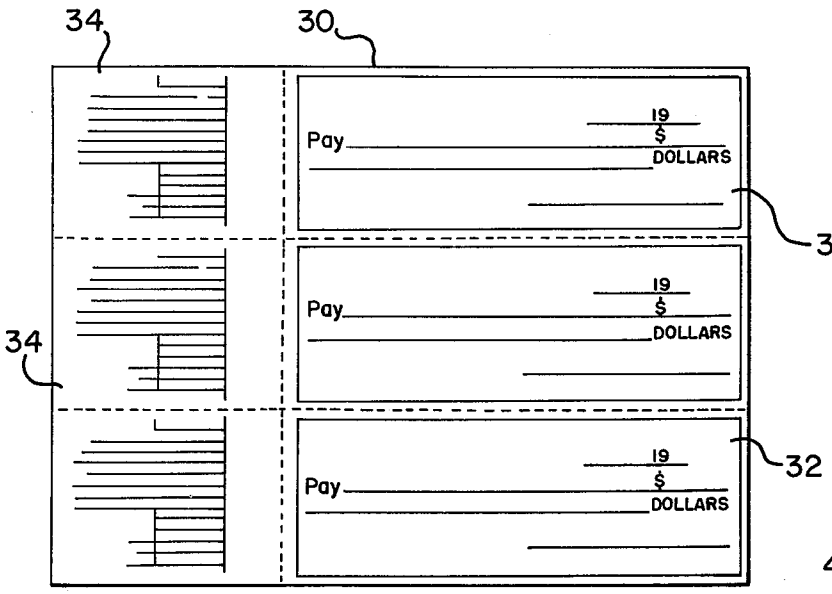
FIG. 2 is a plan view illustrating check blanks as they appear prior to a printing operation.

FIG. 2 illustrates a typical sheet 30 comprising three check blanks 32 with stub portions 34. This sheet is of the type to be located on said table 12 and it already has printed thereon material common to all checks such as the words "Pay" and "Dollars". It will be appreciated that the apparatus can be set up for the printing of checks of many different sizes and configurations, and the printing operation in the apparatus may involve more or less of the total printing to be finally displayed on a check. As already indicated, the invention is also not limited to use for check printing.

FIG. 2A illustrates in a schematic fashion numbering machines of a type contemplated for use in accordance with this invention. Such machines, which are conventional and do not form a part of this invention, comprise mounting rings 36 which serve as means for mounting the machines on a rotatably driven shaft 38. Numbering heads 40 are provided for each machine, and these numbering heads carry indexing arms 42 which are engageable with cams 44 supported on shaft 46. It will be appreciated that as the shaft 38 is rotated, the indexing arm 42 of each numbering head will engage a cam 44 once per revolution. The operation of the machines is such that numbers thereon will be indexed as desired.

Arms 45 are attached to shafts 46, and springs 47 along with fixed abutments 49 normally hold the arms in the position shown. In this position, the cams 44 are out of engaging position with the indexing arms 42; however, after the chase 22 is moved to printing position, means (to be described) operate to engage arms 45 and pivot cams 42 into engaging position (See FIG. 12).

Figure 3:
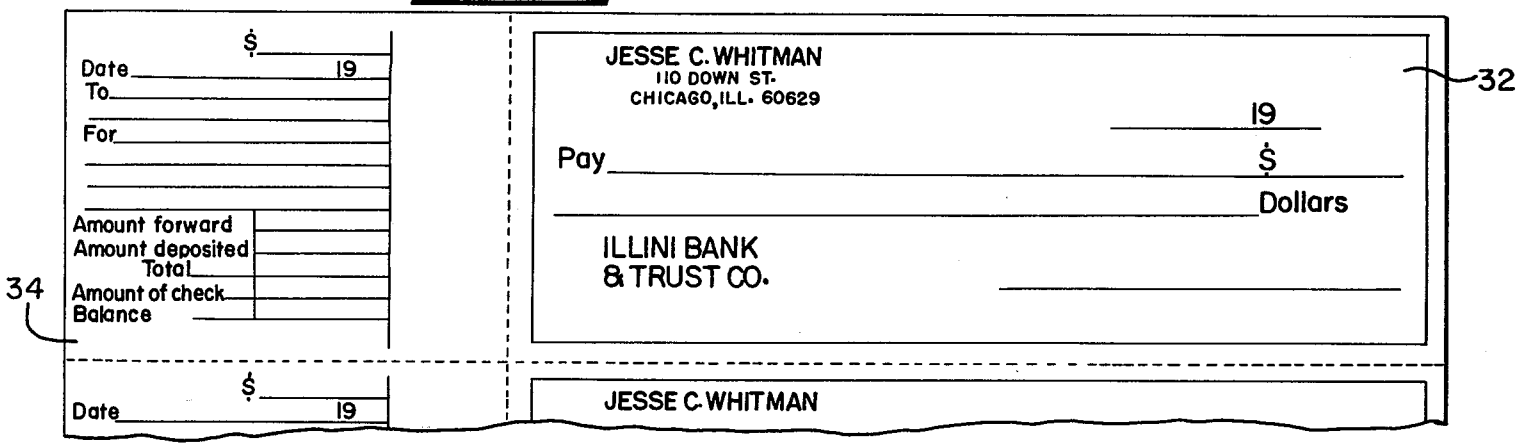
FIG. 3 illustrates a fragment of a check blank showing information printed on the blank by means of the offset printing press.

As shown in FIG. 3, a check blank 32 may have the personal information of a depositer, and the name of the bank, printed by the conventional offset printing press mechanisms. This printing will be common to every check of a given run.

Figure 4:
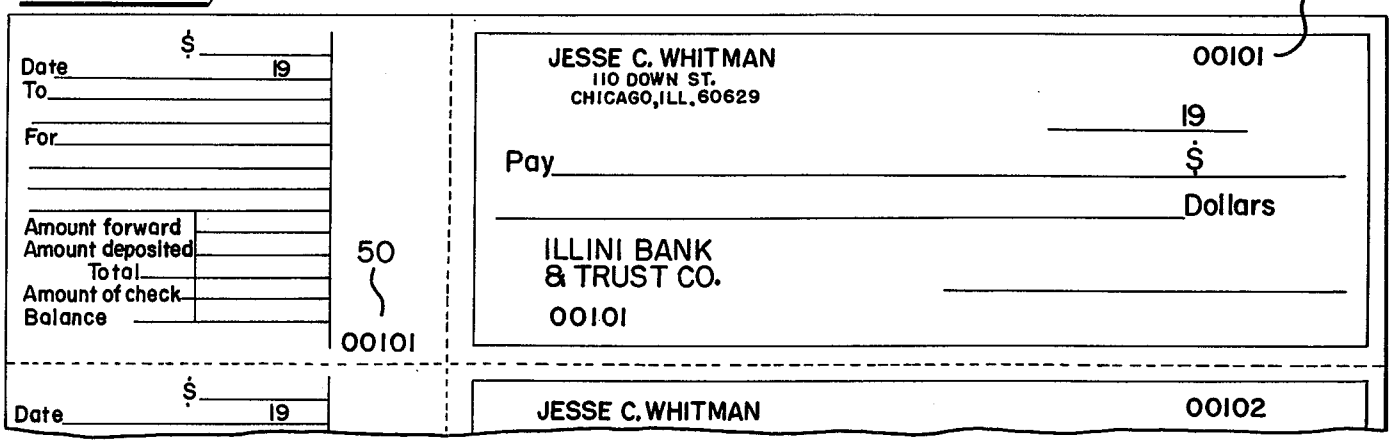
FIG. 4 is a fragmentary illustration of a check blank illustrating numbers added to the check by means of the serial numbering machines.

As shown in FIGS. 4 at 48 and 50, the serial numbering machines may be employed for printing check numbers in sequence on each check and on each stub. In the particular example shown in FIGS. 2 and 2A, the numbering machines are located in alignment with the three check blanks so that a number will be applied at the top of each check blank by one set of three numbering machines and a corresponding number applied to each stub for the respective blanks by another set of three numbering machines.

FIGS. 5 through 15 illustrate the details of the rotary chase incorporating the features of this invention. The chase 22 comprises side plates 52 rotatably supporting separate numbering machine drive shafts 38. Each of the drive shafts supports a plurality of numbering machines 54.

The side plates 52 each have a hub 56 extending outwardly therefrom. A chase support arm 58 is positioned on each side of the apparatus, and these arms define bifurcated ends adapted to receive the respective hubs 56. The hubs are preferably threadably received by the side plates with knobs on the hubs so that the ends of the support arms can be tightened against the side plates to thereby releasably lock the chase against movement relative to the support arms.

Figure 5:
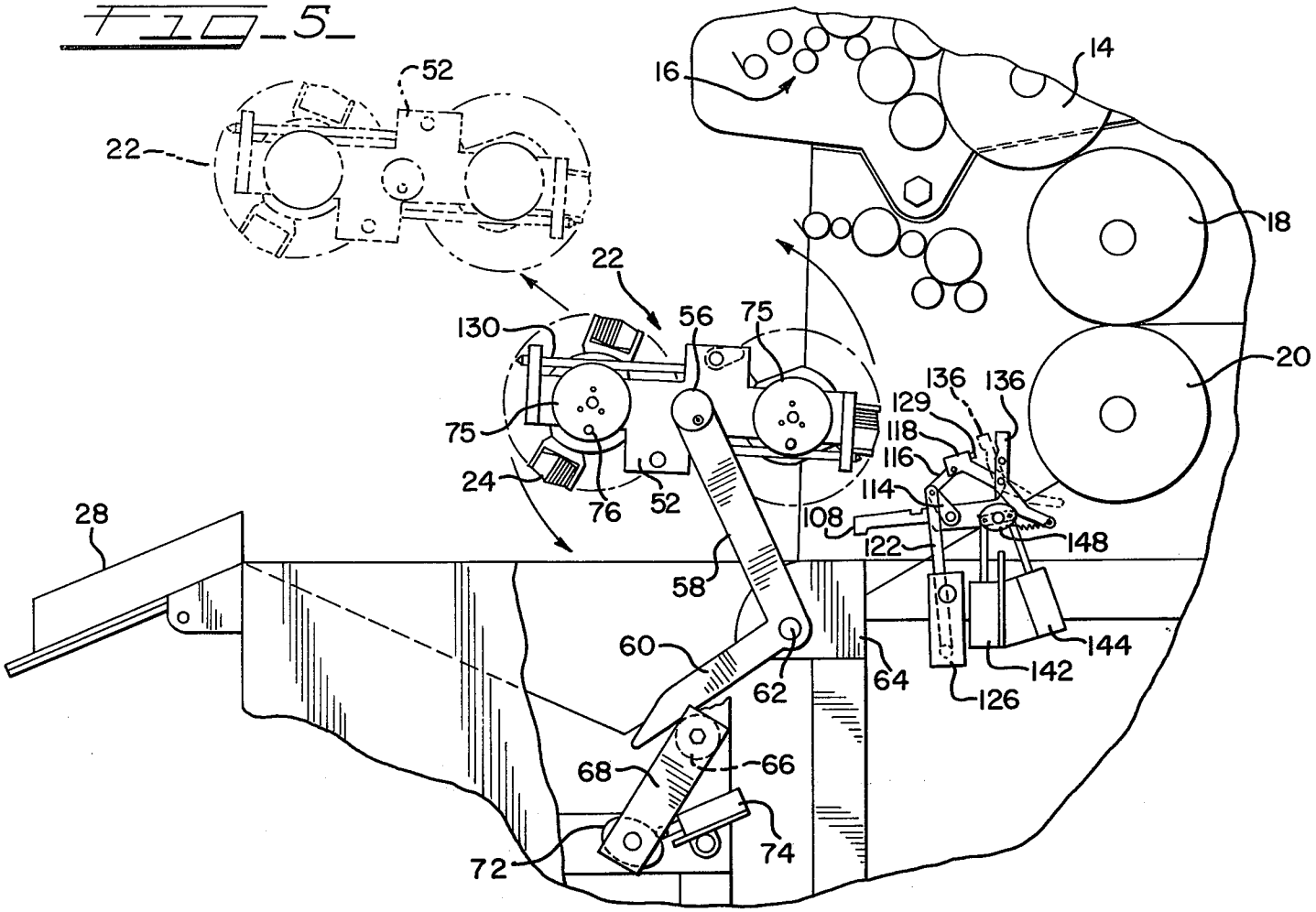
FIG. 5 is an enlarged fragmentary illustration of the offset printing press showing a rotary chase in a non-operating position.
Figure 8:
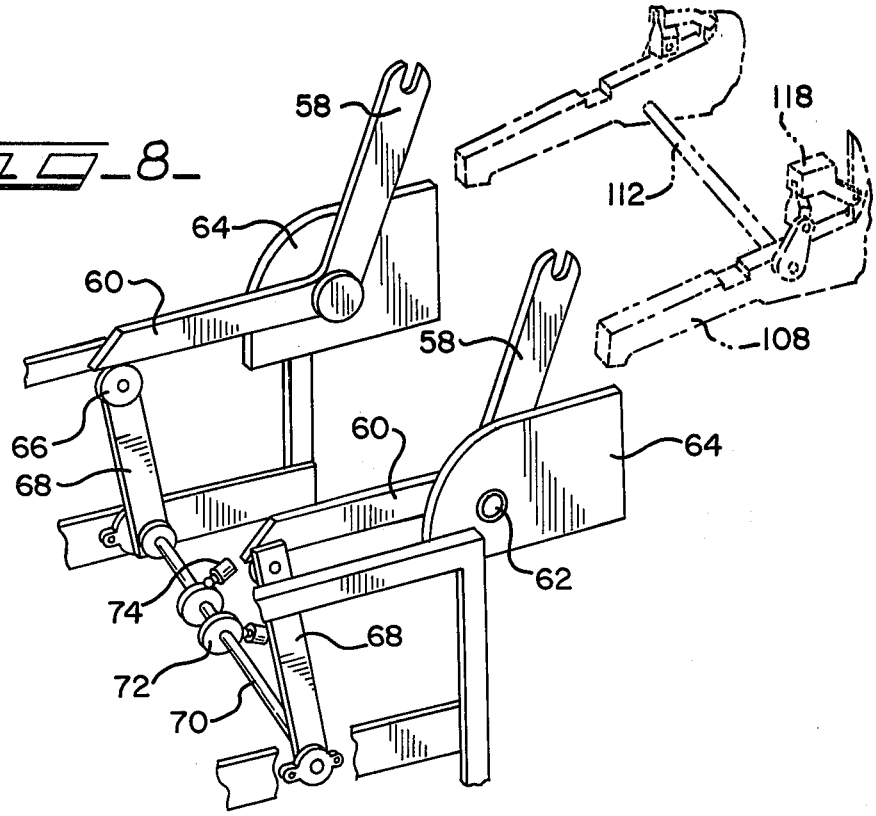
FIG. 8 is a fragmentary perspective illustrating details of the lifting arm and chase support arm structure.

The support arms have lever arms 60 extending outwardly from a pivotal mounting 62. This pivotal mounting is provided by support 64 which is attached to the frame of the apparatus. The lever arms are engageable with bearings 66 carried by lifting arms 68 which are also pivotally mounted to the apparatus frame. The lifting arms 68 are fixed to a shaft 70 as shown in FIG. 8, and this shaft is connected to a motor (not shown). As best illustrated in FIG. 5, right to left pivoting movement of the lifting arms 68 in response to driving of shaft 70 will impart clockwise movement to the support arms 58 to achieve movement of the chase 22 from the non-operating position shown to an operating position adjacent impression cylinder 20. In this position, one set of the numbering machines 54 can be located in position for a printing operation (See FIG. 1).

Cams 72 are also attached to shaft 70 for movement therewith. Microswitches 74 are engageable by the cams for shutting off the drive motor for the shaft at each end of the path of movement of the lifting arms 68. The cams 72 are adjustable on the shaft 70 by means of set screws so that the extremes of movement of the lifting arms 68 can be controlled, and with similarly precise control thus being provided for the extremes of movement of the rotary chase 22.

The movement of the rotary chase can be more readily understood from a consideration of FIGS. 1 and 5. It will be noted that with the chase in the position of FIG. 5, the lever arms 60 engage the bearings 66 so that counterclockwise pivoting movement of lifting arms 68 will pivot support arms 58 clockwise. While the bearings 66 are still in contact with lever arms 60, the chase reaches an over-center position so that additional driving movement by the lifting arms 68 is not required. At this point, the operator can merely slide the chase into operating position with minimum effort as will be explained in greater detail.

When a printing operation is completed, the operator will first slide the chase from right-to-left out of operating position until the chase is again moved over-center with the lever arms 60 brought to rest on bearings 66. The operator will then start the drive motor which will return the chase to the position shown in FIG. 5.

Figure 9:
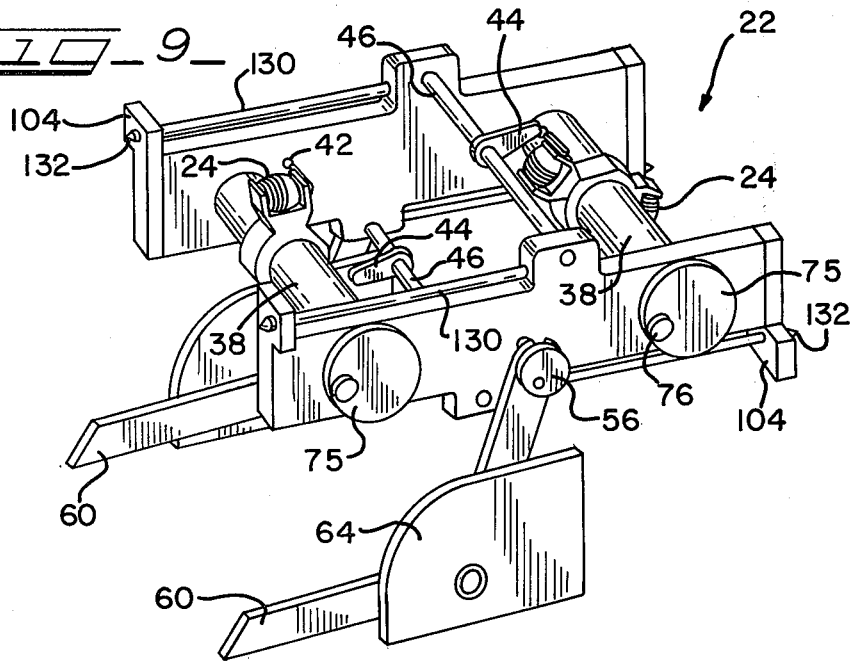
FIG. 9 is a fragmentary perspective view illustrating the chase structure with associated numbering heads.

The manner of supporting the numbering machines 54 on the rotary chase 22 is illustrated in FIG. 9. As shown, supporting shafts 38 extend between the side plates 52 on opposite ends of the chase. The mounting rings 36 are slideably and rotatably supported on the shafts to permit adjustment of the rings both axially and circumferentially of the shafts. Each of the shafts 38 is attached to a crank 75 located on the outside of one of the side plates 52. A drive pin 76 is attached adjacent the edge of each of the cranks 75.

The rotary chase is freed for rotation about the ends of support arms 58 when the locking hubs 56 are released. This rotation is accomplished when the chase has been moved to the non-operating position shown in FIG. 5. The rotation serves to reverse the positions of the shafts 38 whereby the numbering heads on one shaft can be moved into position for a printing operation while the numbering heads on the other shaft are moved out of position. More specifically, the numbering heads to the right-hand side in FIG. 5 are located for movement into printing position when the lifting arms 68 are driven to move the rotary chase from left to right. If the rotary chase were rotated 180° from the position shown in FIG. 5, the other set of numbering heads 54 would be ready for movement into the printing position.

The sole support for the rotary chase in the position shown in FIG. 5 comprises the upper ends of the supporting arms 58. When the locking hubs 56 are released, it is, therefore, also possible to lift the entire chase off the support arms as indicated in dotted lines in FIG. 5. A complete new chase with different numbering heads can then be substituted.

The combination shown in FIG. 5 provides great versatility in that two sets of printing heads are positioned on a rotary chase for selective use. The rotary chase is located in an open area of the offset printing press so that an operator can work on one set of printing heads to change these heads even during press operation. Accordingly, a new set of heads can be ready for movement into operating position very quickly after another set of heads has been utilized for a printing operation.

In addition, the entire rotary chase can be quickly removed, and a new chase with new heads substituted as soon as a printing operation has been completed. Both the operation of rotating the chase to provide a new set of heads in operating position and the operation of substituting a complete new chase simply require the release of the locking hubs 56 along with a minimum of manual effort.

Figure 10:
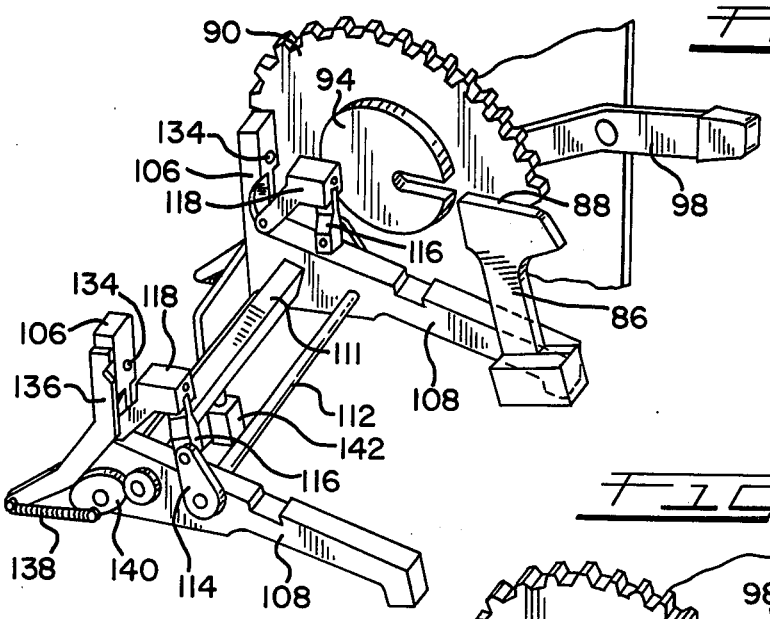
FIG. 10 is a fragmentary perspective view illustrating a bracket structure and numbering head drive means for connection with the rotary chase when moved to operating position.
Figure 12:
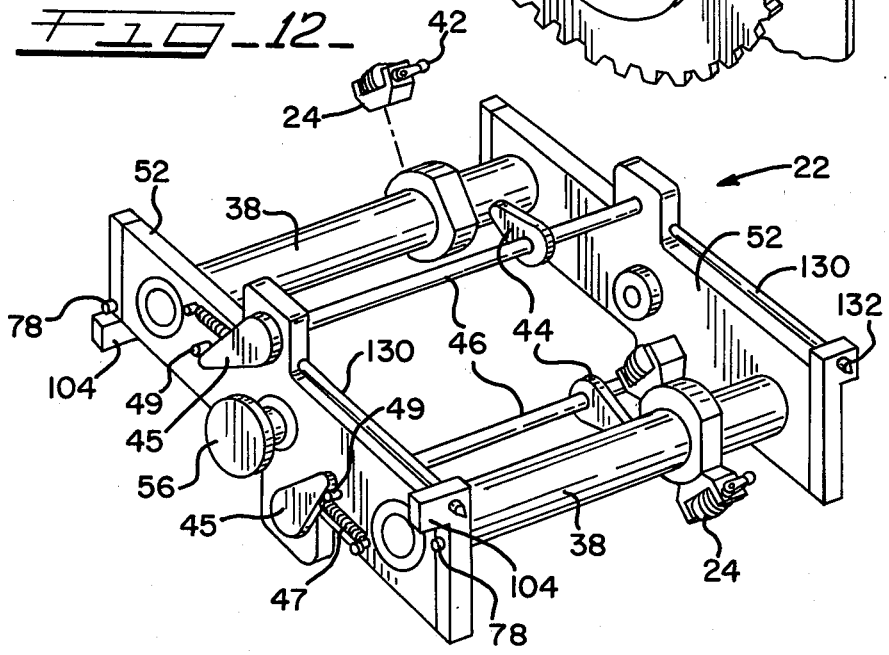
FIG. 12 is a fragmentary perspective view of the rotary chase viewed from the side opposite the view of FIG. 9.
Figure 11:
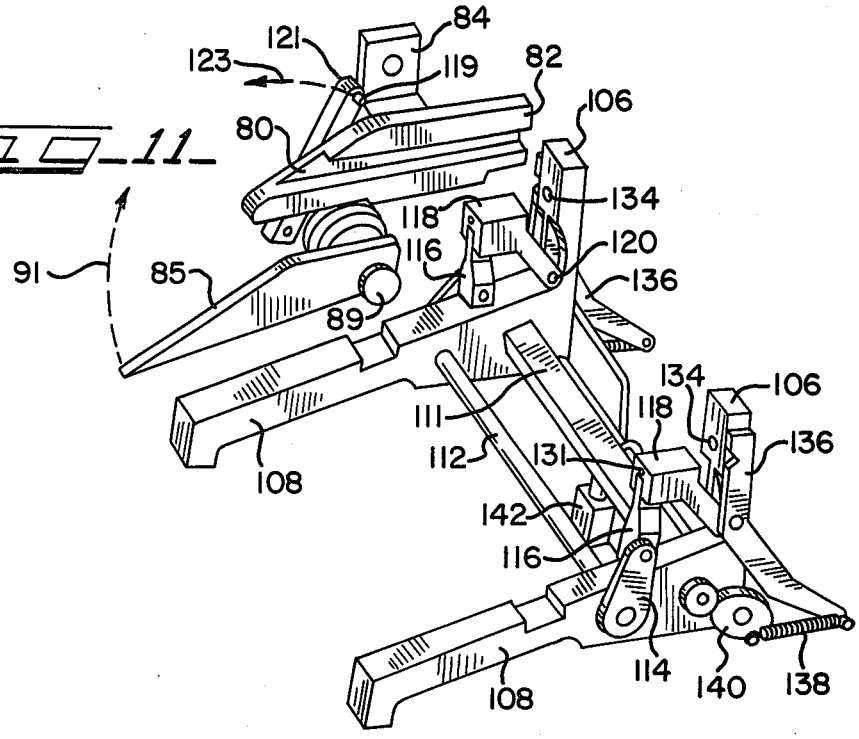
FIG. 11 is a fragmentary perspective view illustrating the opposite side of the bracket structure of FIG. 10 with guide means for the rotary chase.

FIGS. 10 through 12 illustrate the structures employed for supporting the ends of the rotary chase which carries the numbering heads moved into position for printing. The one side plate of the chase carries a guide pin 78 at each end adapted to be received in the slot 80 defined by guide 82. A bracket 84 attached to the press frame supports this guide in a stationary position. When the chase is moved into operating position from the position shown in FIG. 5, the pin 78 will automatically locate within the slot 80 to maintain alignment on that side of the apparatus.

A ramp 85 fixed to the apparatus frame is employed for initially engaging the corner 104 of the chase 22 to assist in guiding the pin 78 into slot 80. The ramp is pivoted to the frame at 89 but is fixed against downward movement beyond the position shown. The ramp is, however, free to pivot upwardly in the direction of arrow 91 so that it will not interfere with rotation of the chase on the support arms 58 when numbering machine positions are being changed.

Figure 6:
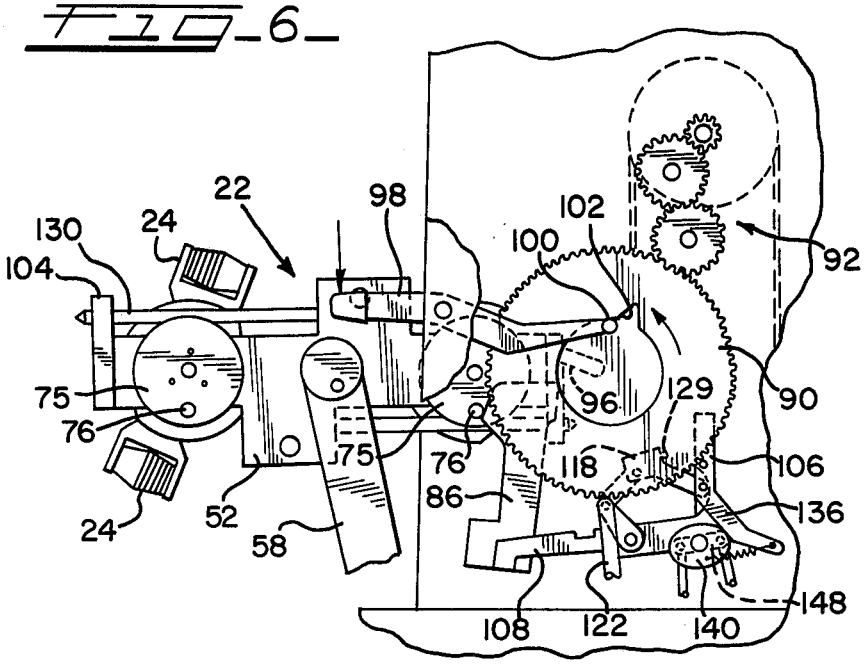
FIG. 6 is a fragmentary elevational view of the printing press showing the rotary chase in a non-operating position and illustrating details of aligning, locking, and shifting means.

A guide 86 is fixed to the press frame on the other side of the path of movement of the rotary chase. This guide is engageable with the pin 76 which is provided on each of the cranks 75 attached to the numbering head shafts 38. As the rotary chase slides into operating position, a pin 76 will automatically ride onto the top surface 88 of the guide 86. FIG. 6 illustrates the pin 76 in engagement with the front end of the guide 86, and since the shaft 38 is freely rotatable at this time, the pin will be forced onto the top surface 88 as the rotary chase moves from left to right in this view. If the pin 76 is located above the surface of guide 86 as the chase is moved into position, the operator can readily rotate shaft 38 to position pin 76 on this top surface.

Figure 7:
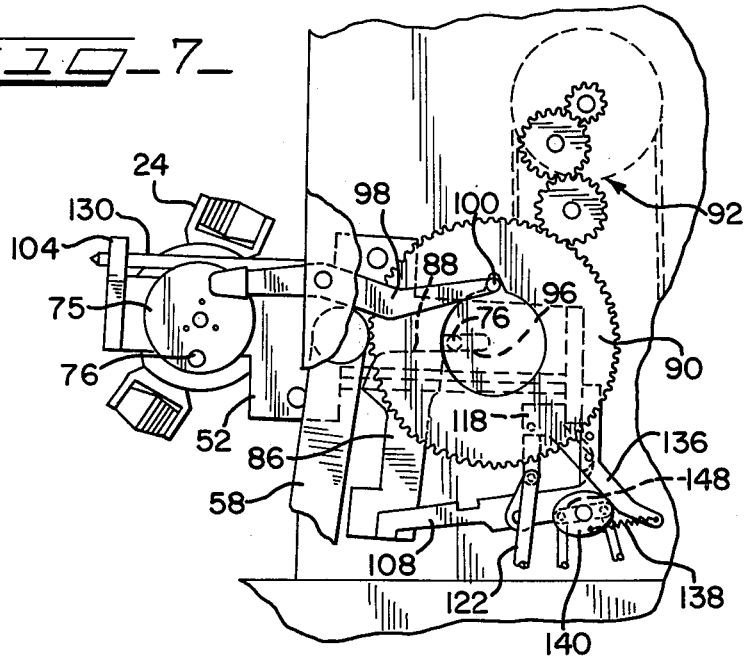
FIG. 7 is a fragmentary elevational view of the offset printing press showing the rotary chase in operating position.

A drive gear 90 is connected to the main drive for the printing press cylinders through gears and pinions 92 illustrated in FIGS. 6 and 7. In this manner, the gear 90 is driven in unison with the press.

As best shown in FIG. 10, the gear 90 carries an axially located disc 94 which defines a slot 96. The pin 76 of a crank 75 is receivable within this slot 96 to tie the gear to the crank and to thus provide driving movement for a shaft 38 and associated numbering heads.

Figure 10A:
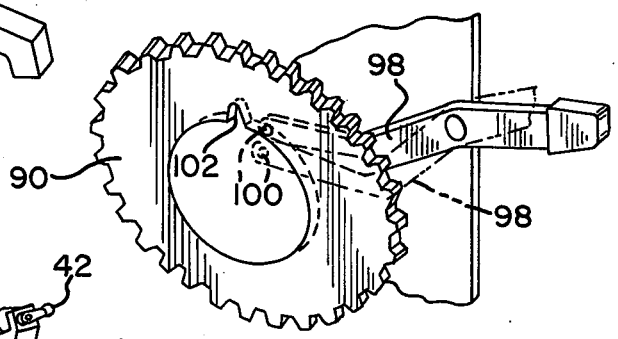
FIG. 10A is a fragmentary perspective view illustrating alignment means for the drive gear.

Prior to moving the rotary chase into position, the slot 96 is first directly aligned with the top surface of guide 86. This is accomplished by means of a manually operable locating lever 98 which is normally spring-urged to the dotted line position shown and the function of which is best illustrated by showing the gear 90 with the disc 94 removed (FIG. 10A). A detent 100 is attached to the end of the locating lever 98, and this detent is adapted to be received in an indented area including notch 102 defined on the outer surface of gear 90. The notch 102 has a predetermined relationship with the slot 96 defined on the opposite side of the gear. The machine operator therefore manually rotates the gear 90 (by means of a wheel typically provided for rotating the press cylinders), and at the same time the operator manually urges locating lever 98 against the portion of gear 90 defining notch 102. When the detent 100 is received within the notch, the operator will be assured that the slot 96 is in proper alignment for receipt of pin 76 on a crank 75. After the chase is in position, the lever 98 will swing free of the notch 102 so that the gear 90 is free to rotate. The lever 98 preferably has sufficient spring characteristics so that the detent will automatically move over the gear indentation and swing free.

Figure 13:
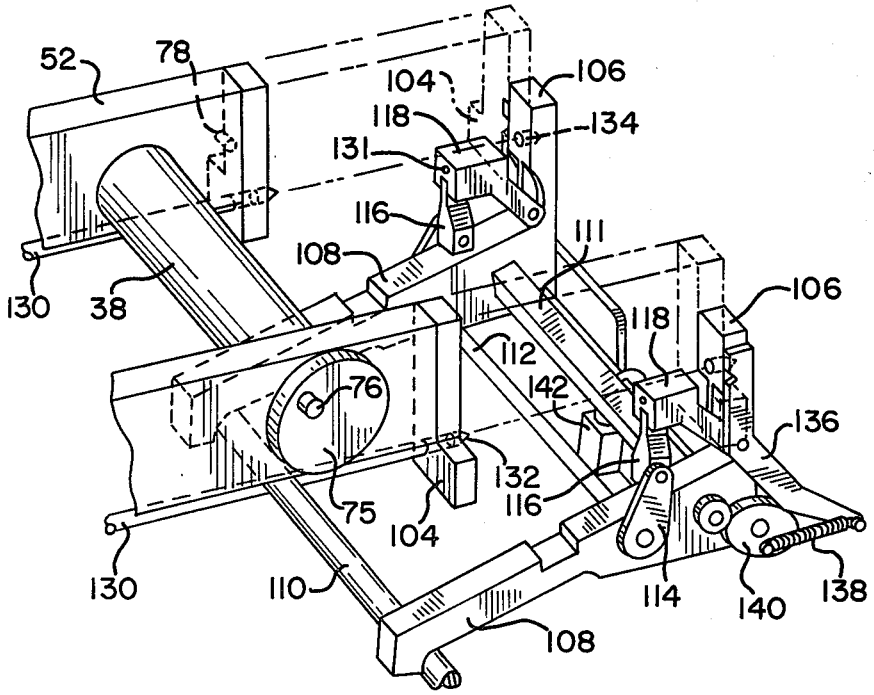
FIG. 13 is a fragmentary perspective view illustrating means for locking the rotary chase numbering machines in operating position and means for moving the chase on and off impression.

As noted, and as illustrated in FIG. 12, the side frames 52 of the rotary chase define corners 104. When the rotary chase is moved into operating position, these corners are moved into engagement with posts 106 which are formed integrally with side plates 108 of a stationary chase-receiving assembly. (FIG. 13). This assembly is mounted in a stationary position on the machine frame, for example by means of a tie bar 110 forming part of the machine frame. One or more of the tie bars of the type shown at 111 may be utilized for securing the frame members 108 in fixed position relative to each other. The frame members 108 each support links 114 and 116. In each case, link 116 is connected to a clamping member 118 which is pivotally connected at 120 to each post 106.

FIGS. 14 and 14A provide detailed views of the mechanism just described. As shown, an arm 122 is connected to link 114, and this arm is attached to shaft 124 which extends outwardly of the machine side wall. A bracket 126 supports operating handle 128 which is thus accessible from the exterior of the machine. The shaft 112 extends across to the opposite frame member 108 so that the movement imparted by handle 128 will be transmitted to the arm 122 on each side of the chase-receiving assembly.

When the operating handle is moved forwardly to the position shown in FIG. 14A, the arms 122 drive the links 114 and 116 whereby the clamping members 118 are pivoted toward posts 106. The arrangement of the links is such that an "over-center" condition is achieved whereby positive force must be applied to the links to achieve unlocking action. Nevertheless, means may be provided to independently latching handle 128 to avoid inadvertent unlocking as people pass by the apparatus.

When the rotary chase slides into position, the corner sections 104 of the rotary chase are located between the clamping members 118 and posts 106. Movement of operating handle 128 to the position shown in FIG. 14A will thus serve to clamp the rotary chase in position relative to the receiving assembly.

To accomplish printing of numbers, the numbering machines 24 must be properly located, and the clamping members 118 normally achieve this function. In addition, the cams 44 must be positioned to engage indexing arms 42 and, as previously noted, this is accomplished by pivoting arms 45 on the chase side plates 52 in opposition to springs 47. This pivoting action is accomplished by drive pin 119 carried on drive arm 121 which is attached for swinging movement to the apparatus frame (FIG. 11). A drive solenoid (not shown) moves pin 119 in the direction of arrow 123 against an arm 45, and the solenoid may be actuated when the operator pushes a button to begin a printing operation.

As is well-known, it is desirable to provide means for moving printing means out of printing position or "Off Impression" at certain times during a printing cycle. The apparatus of this invention provides means for automatically moving the numbering machines "On" and "Off" impression while at the same time maintaining precise printing pressure and alignment during printing.

This function is achieved by a combination of the clamping members 118 and drive levers to be described. Specifically, the clamping members, as best shown in FIG. 15, carry spring-loaded buttons 129 which bear against corner sections 104 when the clamping members are moved into position. These spring-loaded buttons maintain a certain predetermined distance between the faces of members 118 and the adjacent surfaces of the corner sections 104 (typically about 0.050 inches).

Levers 136 are pivotally attached to the sides of posts 106 for engaging corner sections 104. These levers are held in engagement with cams 140 by means of springs 138. Solenoids 142 and 144 operate to drive cams 140 relative to the levers 136 through shaft 146 which carries element 148. The respective solenoids operate to pivot this element in opposite directions to achieve movement of shaft 146 and consequent oscillating movement of cams 140.

When solenoid 142 is actuated, the cams 140 are pivoted counterclockwise to move the levers 136 from the solid-line positions shown in FIG. 5 to the dotted-line position shown. Since the levers 136 are positioned immediately adjacent posts 106, the levers operate to drive the rotary chase away from the posts in opposition to the pressure of the spring-loaded buttons 129. This moves the numbering machines to an "Off Impression" position; operation of the solenoid 144 will serve to pivot levers 136 back and return the machines to the "On Impression" position.

The spring-loaded buttons 129 are preferably of a conventional design which can be adjusted by means of set screws 131 accessible from the back of clamping members 118. In this manner, the pressure applied by the buttons can be adjusted relative to the strength of solenoid 142 which must overcome the button force and move the chase sufficiently to achieve the "Off Impression" condition.

The operation of solenoids 142 and 144 may be accomplished by any suitable means including a computer controlled system which will achieve the movement of the numbering machines to the off impression position in accordance with any desired sequence.

The operation of the solenoid controlling drive arm 121 (FIG. 11) can be readily synchronized with the operation of solenoids 142 and 144 so that the cams 44 will not index the numbering machines when the apparatus is off-impression. It is preferred that the solenoid operating arm 121 be actuated one cycle later than the solenoid 144 to insure that a number will not index before the apparatus in on impression.

Means are also provided for achieving fine adjustment of the rotary chase relative to the post 106. These means include rotatable rods 130 defining conical ends 132. As shown in FIGS. 1 and 12, these rods are carried at the top and bottom of the side frames 52 of the rotary chase. The rods are located so that the conical ends 132 of the bottom set of rods will be facing posts 106 of the stationary receiving assembly when the rotary chase is moved to operating position.

The posts 106 each define conical bores 134 dimensioned to receive the ends 132. The rods 130 are threadably carried by the side frame members 52 and the operator can, therefore, adjust the position of the rotary chase relative to the posts 106 after the rotary chase is moved into position. This may be accomplished using a screwdriver, and it will be appreciated that this adjustment will determine the pressure of the numbering heads on the stock being fed through the machines. This is of particular value where magnetic ink is being applied since very careful controls are required to accommodate the printed numbers to the automatic reading equipment.

The utilization of the rods 130 and bores 134 on the posts 106 also insures accurate transverse alignment of the rotary chase relative to the stationary receiving assembly. In addition, the rotary chase will automatically be secured in a precise parallel position relative to the receiving assembly. This feature is highly important from the standpoint of minimizing operator time which would otherwise be required to insure registry of numbers being printed.

It will be understood that various changes and modifications may be made in the above-described construction which provide the characteristics of the invention without departing form the spirit thereof as described in the following claims.

I claim:

1. In a printing apparatus for serially printing characters on print stock being transported through the apparatus including separate serial printing heads, a movable mounting means for supporting the respective heads on opposite sides of the mounting means, and means for moving said mounting means between first and second positions for selectively locating one or the other of said heads in position for printing on said stock, the improvement comprising a support for said mounting means, said support and mounting means being fixed in an assembled relationship, means defined by said support for rotatably supporting said mounting means, means for moving said support back and forth generally along the path of movement of the stock, the movement of the support being between an operating position where one of the printing heads on the mounting means is in position for printing, and a non-operating position where neither of the heads is in position for printing, means for locking the assembly of the support and mounting means in place in the apparatus when said support is moved to the operating position to thereby locate a printing head in said position for printing, said mounting means, when the support is in non-operating position, being rotatable on the support to reverse the positions of said heads on said support, said mounting means being releasably fixed on said support whereby the mounting means can be lifted off said support when the support is in non-operating position and removed from the apparatus with a new assembly of mounting means and heads being substituted into the apparatus, and wherein a printing head not in the printing position is accessible to an operator of the apparatus when the support is located in operating position so that the printing head not in printing position can be reset while the apparatus is operating.

2. An apparatus in accordance with claim 1 wherein said support is mounted on a pivot axis extending generally across the path of movement of the stock through the apparatus, and wherein said mounting means is rotatably supported by the support on an axis generally parallel with said pivot axis.

3. An apparatus in accordance with claim 1 wherein said support comprises opposed arms, said mounting means being rotatably supported on the upper ends of said arms, and drive means connected to said arms for driving the arms and for thereby moving said support between said operating and non-operating positions.

4. An apparatus in accordance with claim 1 wherein said mounting means comprises a rotary chase including spaced-apart side frame members, hub means carried by said side frame members, said support comprising opposed arms pivotally mounted to the apparatus, the upper ends of said arms defining means for rotatably receiving said hub means, and means for releasably connecting said hub means to said ends of said arms.

5. An apparatus in accordance with claim 4 comprising offset printing means including an impression cylinder, said arms being adapted to pivot said rotary chase into said operating position such that a printing head will be disposed in facing relationship with the surface of the impression cylinder.

6. An apparatus in accordance with claim 5 wherein said arms support said rotary chase above the path of movement of said stock, a printing head not in printing position being accessible for resetting while the other printing head is positioned adjacent said impression cylinder.

7. An apparatus in accordance with claim 6 wherein said rotary chase is accessible for removal from said arms when said arms move the rotary chase to a non-operating position.

8. An apparatus in accordance with claim 1 wherein said locking means include resilient means engaging said mounting means to hold the mounting means in operating position, and including additional engaging means associated with said apparatus for applying forces to said mounting means to move said mounting means in opposition to said resilient means for thereby moving the mounting means away from operating position while said locking means are engaged.

9. An apparatus in accordance with claim 8 wherein said locking means are manually engaged when said support is moved to operating position, and wherein said additional engaging means operate automatically while the support is in operating position.

10. An apparatus in accordance with claim 1 including guide means engageable with the side of said mounting means holding a printing head to be moved to a printing location, the guide means being engageable during movement of said support to operating position to thereby accurately locate the printing head in the printing position.

11. An apparatus in accordance with claim 10 wherein said guide means comprise means fixed in the apparatus and cooperating means movably located on said mounting means.

12. An apparatus in accordance with claim 11 wherein the guide means located on said mounting means comprise threadably supported pins, the guide means in said apparatus comprising recess for receiving said pins, said pins being adjustable relative to the recesses for achieving precise alignment of the mounting means in the apparatus.

13. An apparatus in accordance with claim 1 wherein said printing heads are mounted on rotatable shafts, and including drive means for each of said shafts, and means for operatively engaging one of said drive means as the support is moved to printing position.

14. An apparatus in accordance with claim 13 wherein said drive means each comprise a rotatable portion mounted on said apparatus and a separate rotatable portion associated with each shaft, one of said portions comprising a drive pin and the other of said portions defining an opening for receiving a drive pin, and means for aligning said portions prior to movement of said support to operating position whereby drive means will be automatically placed in driving engagement when said support is moved to operating position.

15. An apparatus in accordance with claim 14 wherein said means for aligning said pin and said opening include manually operated means.

16. An apparatus in accordance with claim 15 comprising offset printing means including an impression cylinder, a drive gear drivingly connected to said impression cylinder, said opening being defined by said drive gear, a drive disc attached to each of said shafts, a drive pin being connected to each drive disc, guide means defining a pin engaging guide surface fixed in said apparatus immediately adjacent said drive gear, a locating pin mounted adjacent said drive gear, a recess defined in the face of said drive gear adapted to receive said locating pin, receipt of said locating pin by said recess serving to place said opening in said drive gear in a predetermined aligned position, engagement of a drive pin with said guide surface serving to place a drive disc in a predetermined aligned position whereby a drive pin will automatically enter the opening defined by said drive gear when said support is moved to operating position.

17. An apparatus in accordance with claim 13 including separate shafts supported on said mounting means adjacent said rotatable shafts, and cam means carried by said separate shafts for operating said printing heads.

18. In an offset printing apparatus of the type including an impression cylinder having a drive gear and having separate serial printing heads, a movable mounting means for the respective heads, and means for moving said mounting means between first and second positions for selectively locating one or the other of said heads in position for printing on said stock, the improvement comprising a support for said mounting means, means defined by said support for rotatably supporting said mounting means, means for moving said support back and forth generally along the path of movement of the stock, the movement of the support being between an operating position where one of the printing heads on the mounting means is in position for printing, and a non-operating position where neither of the heads is in position for printing, said mounting means, when the support is in non-operating position, being rotatable on the support to reverse the positions of said heads on said support, said printing heads being mounted on rotatable shafts, drive means for each of said shafts, and means for engaging one of said drive means as the support is moved to printing position, said drive means each comprising a rotatable portion mounted on said apparatus and a separate rotatable portion associated with each shaft, one of said portions comprising a drive pin and the other of said portions defining an opening for receiving a drive pin, and means for aligning said portions prior to movement of said support to operating position whereby drive means will be automatically placed in driving engagement when said support is moved to operating position, said means for aligning said pin and said opening including manually operated means, said opening being defined by said drive gear of the impression cylinder, a drive disc attached to each of said shafts, a drive pin being connected to each drive disc, guide means defining a pin engaging guide surface fixed in said apparatus immediately adjacent said drive gear, a locating pin mounting adjacent said drive gear, a recess defied in the face of said drive gear adapted to receive said locating pin, receipt of said locating pin by said recess serving to place said opening in said drive gear in a predetermined aligned position, engagement of a drive pin with said guide surface serving to place a drive disc in a predetermined aligned position whereby a drive pin will automatically enter the opening defined by said drive gear when said support is moved to operating position.

* * * * *